US007861333B2

(12) United States Patent
Grossman et al.

(10) Patent No.: US 7,861,333 B2
(45) Date of Patent: Jan. 4, 2011

(54) FRAMES FOR FUTON SOFA BEDS AND METHODS OF SECURING SLATS THEREIN

(75) Inventors: Joel Grossman, Selangor (MY); Howard Porter, Kuala Lumpur (MY); Sin Keong Loo, Selangor (MY)

(73) Assignee: Night and Day Furniture LLC, Vancouver, WA (US)

( * ) Notice: Subject to any disclaimer, the term of this patent is extended or adjusted under 35 U.S.C. 154(b) by 280 days.

(21) Appl. No.: 11/878,830

(22) Filed: Jul. 27, 2007

(65) Prior Publication Data

US 2009/0025142 A1 Jan. 29, 2009

(51) Int. Cl.
*A47C 17/04* (2006.01)

(52) U.S. Cl. ..... 5/37.1; 5/47; 5/236.1

(58) Field of Classification Search ..... 5/37.1, 5/47, 236.1, 237

See application file for complete search history.

(56) References Cited

U.S. PATENT DOCUMENTS 4,752,981 A * 6/1988 Salens ..... 5/238
6,219,863 B1 * 4/2001 Loberg et al. ..... 5/236.1
6,256,815 B1 * 7/2001 Degen ..... 5/236.1

* cited by examiner

*Primary Examiner*—Fredrick Conley
(74) *Attorney, Agent, or Firm*—Harness, Dickey & Pierce, P.L.C.

(57) ABSTRACT

A slat connector for use with a futon sofa bed may be used for connecting a slat to a rail of a frame of the futon sofa bed. The slat connector may include a body having an opening for receiving an end portion of a slat, and a protrusion extending in a generally normal direction from an outer surface of the body. The rail of the frame may include an opening for receiving the protrusion of the connector for connecting the slat to the rail.

12 Claims, 8 Drawing Sheets

FRAMES FOR FUTON SOFA BEDS AND METHODS OF SECURING SLATS THEREIN

FIELD

The present disclosure relates generally to futon sofa beds, and more particularly to a futon sofa bed frame with slats and a method of securing slats within a futon sofa bed frame.

BACKGROUND

The statements in this section merely provide background information related to the present disclosure and may not constitute prior art.

The futon sofa bed retail market has been expanding into internet direct sales for several years. As with any direct-to-consumer selling, commercial delivery services play an important role in completing the supply chain, being a critical link in getting the product to the end user. As such, coordinating the design and packaging of large furniture items to fit within the service requirements of these carriers is desirable. In fact, a piece of packed furniture exceeding the overall dimensional limitations of a carrier may not be accepted by the carrier. A piece of furniture packed within the dimensional limitations may nonetheless be large, inefficient, and expensive to ship, thus hurting the retailer's competitiveness.

SUMMARY

Example embodiments may provide connectors for use in connecting slats to rails of futon sofa bed frames as well as futon sofa bed frames that may be easier for end users to assemble and that may facilitate smaller and more efficient product packaging.

In an example embodiment, a connector may be used for connecting a slat to a rail of a deck of a futon sofa bed frame. The connector generally comprises a body having an opening for receiving an end portion of a slat into the opening, and a protrusion extending in a generally normal direction from an outer surface of the body.

In another example embodiment, a frame for a futon sofa bed generally comprises rails coupled together to define a deck region. The rails include first and second opposing rails where the first rail includes an opening formed therein. A slat extends between the first and second opposing rails within the region defined by the rails. A connector connects the slat to the first rail. The connector includes a protrusion configured for reception within the opening of the first rail for connecting the slat to the first rail. At least part of the protrusion received within the opening has a width dimension larger than a width dimension of the opening and is deformable for allowing reception of the protrusion into the opening.

In still another example embodiment, a frame for a futon sofa bed generally comprises rails coupled together to define a deck region. The rails include first and second opposing rails, and a slat extends between the first and second opposing rails within the region. A guide is provided at the first rail for connecting the slat to the first rail independent of tools and separate hardware.

In a further example embodiment, a frame for a futon sofa bed generally comprises rails coupled together to define a deck region. The rails include first and second opposing rails, and slats connect between the first and second opposing rails within the deck region. At least one of the slats has a longitudinal end that includes two or more end tabs connecting the at least one slat to the first rail.

In still another example embodiment, a frame for a futon sofa bed generally comprises rails coupled together to define a deck region. The rails include first and second opposing rails, and slats connect between the first and second opposing rails within the region in spaced apart orientation. The slats include consecutively positioned first, second, third, and fourth slats where a spacing between the first and second slats is about the same as a spacing between the third and fourth slats. A spacing between the second and third slats, however, is greater than the spacing between the first and second slats and the spacing between the third and fourth slats.

Example embodiments may also provide a method of securing slats of a futon sofa bed frame that may allow for easier assembly by the end user and may facilitate smaller and more efficient product packaging.

In an example embodiment, a method is provided for installing slats to a frame of a futon sofa bed independent of tools and separate hardware. The method generally comprises installing a connector to an end portion of a slat where the connector includes a protrusion extending in a generally normal direction from a surface of the slat. The method also generally comprises deforming at least part of the protrusion, and inserting the deformed part of the protrusion into an opening of a rail of the futon sofa bed frame.

Further areas of applicability will become apparent from the description provided herein. It should be understood that the description and specific examples are intended for purposes of illustration only and are not intended to limit the scope of the present disclosure.

DRAWINGS

Example embodiments will be described below with reference to the accompanying drawings.

DESCRIPTION

Figure 1:
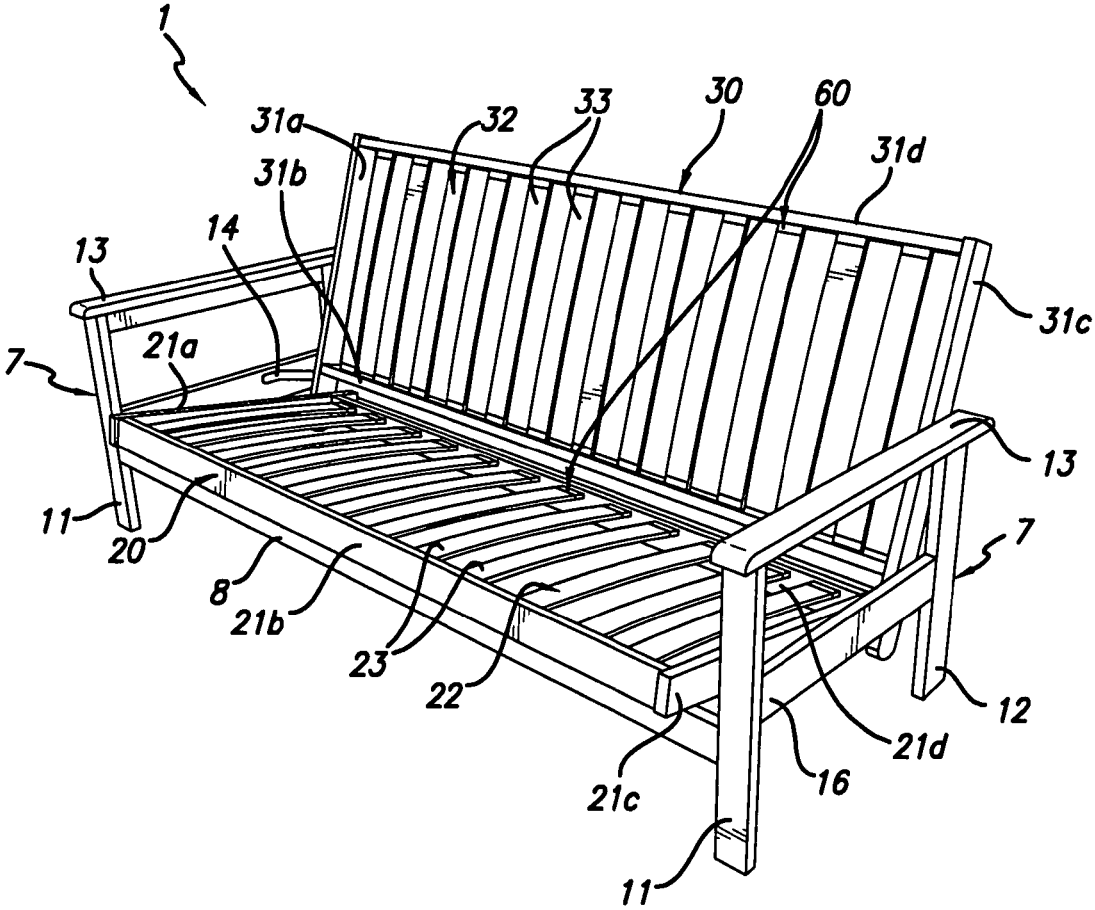
FIG. 1 is a perspective view of an example embodiment of a frame for a futon sofa bed.

The following description is merely example in nature and is not intended to limit the present disclosure, application, or uses. It should be understood that throughout the drawings, corresponding reference numerals indicate like or corresponding parts and features.

Example embodiments will now be described more fully with reference to the accompanying drawings. Example embodiments may, however, be embodied in many different forms and should not be construed as being limited to the example embodiments set forth herein. Rather, these example embodiments are provided so that this disclosure will be thorough, and will fully convey the concept of the invention to those skilled in the art.

Figure 2:
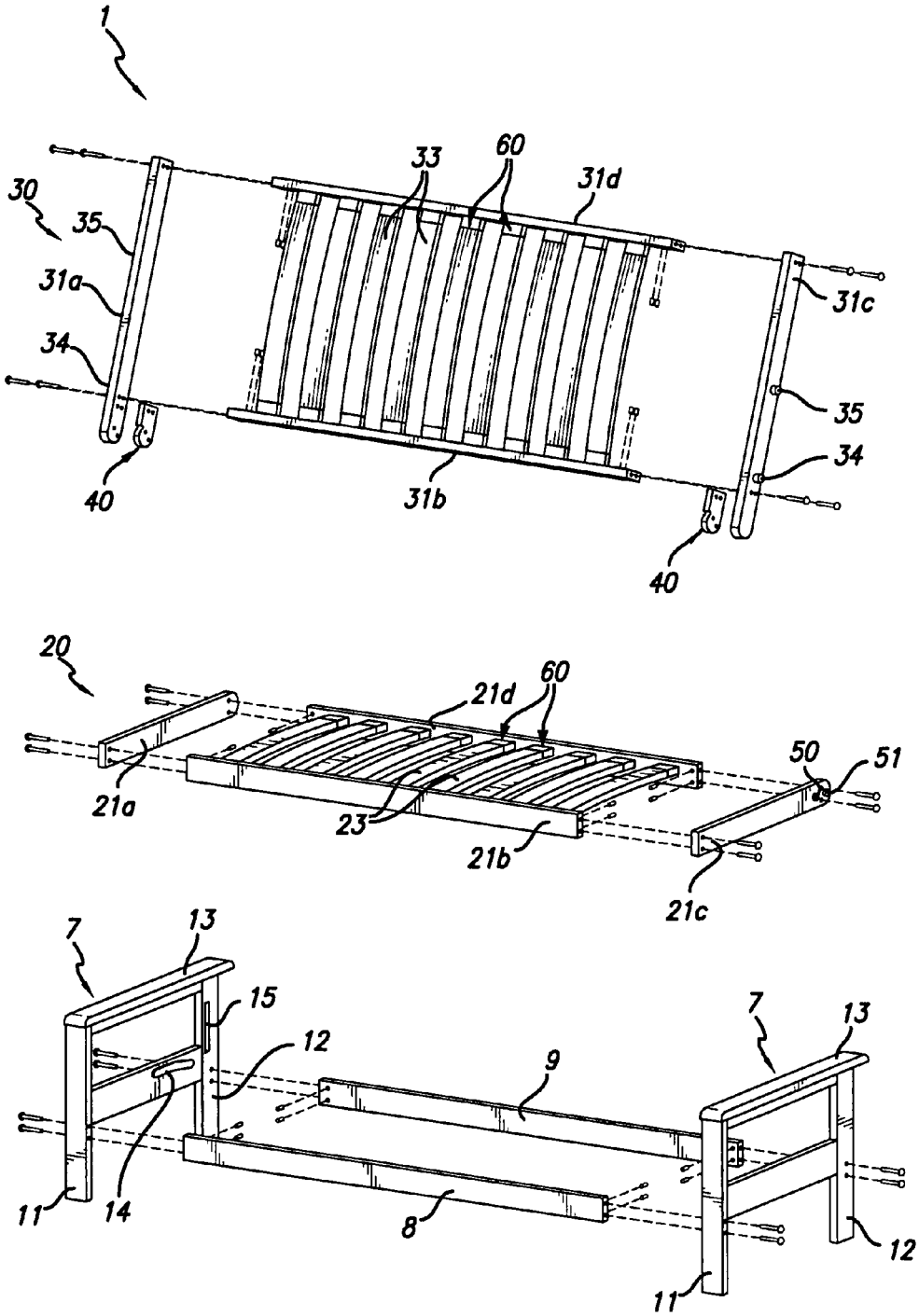
FIG. 2 is an exploded perspective view of the futon sofa bed frame.

With reference now to the drawings, FIGS. 1 and 2 illustrate a frame 1 for a futon sofa bed. A mattress (not shown) may be placed on the futon sofa bed frame 1 for comfort in, for example, sitting and/or lying on the bed. The illustrated frame 1 is constructed from wood; however it may be constructed from metal, combinations of metal and wood, etc. within the scope of the present disclosure.

The futon sofa bed frame 1 may generally include a pair of spaced-apart stationary arm panels 7 and a pair of spaced-apart and parallel forward and rearward stretcher rails 8 and 9 extending in a generally width-wise direction between the stationary arm panels 7. Each stationary arm panel 7 may include a pair of legs 11 and 12 that extend from an armrest 13 to the floor. The legs 11 and 12 of each of the stationary arm panels 7 are spaced apart along a depth-wise direction, generally transverse to the width-wise direction in which the stretcher rails 8 and 9 extend. The stretcher rails 8 and 9 may be associated with each stationary arm panel 7 and may extend between the respective legs 11 and 12 of each arm panel 7. The arm panels 7 may include additional depth-wise and/or width-wise rails (not shown) within the scope of the present disclosure.

Figure 3:
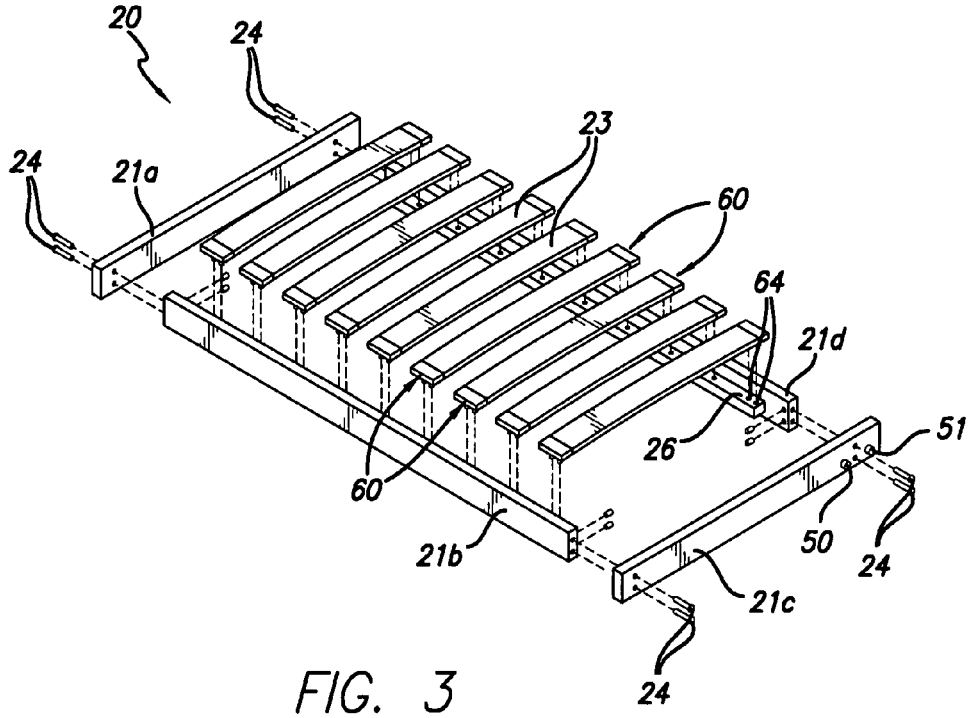
FIG. 3 is an exploded perspective view of a seat-deck of the futon sofa bed frame of FIG. 1.

The futon sofa bed frame 1 may also include a seat-deck 20 and a back-deck 30 operatively connected to the seat deck 20. As shown in FIGS. 1-3, the seat-deck 20 may include multiple rails, for example rails 21*a-d*, end portions of which may be coupled or connected together to form/define a boundary enclosing a region 22 (FIG. 1) having multiple slats 23. For example, in example embodiments the region 22 may include a generally rectangular shape. However, the region 22 may include any other shape desired within the scope of the present disclosure. To that end, the illustrated seat-deck 20 may include four rails 21*a-d* coupled together by fasteners 24 (e.g., screws, bolts, etc.) (FIG. 3) to form the generally rectangular shape. Rails 21*a* and 21*c* are spaced apart and extend generally parallel to each other, and rails 21*b* and 21*d* extend generally transverse thereto. Rails 21*b* and 21*d* are also spaced apart and extend generally parallel to each other, with the slats 23 extending between the rails 21*b* and 21*d*. Supports 26 (FIG. 3) are configured lengthwise along inside faces of rails 21*b* and 21*d* to provide support underneath the slats 23 and/or locations to connect the slats 23 to the rails 21*b* and 21*d*, as will be described in more detail hereinafter. In other example embodiments, futon sofa bed frames may be free of supports with slats connecting directly to the frames.

Figure 4:
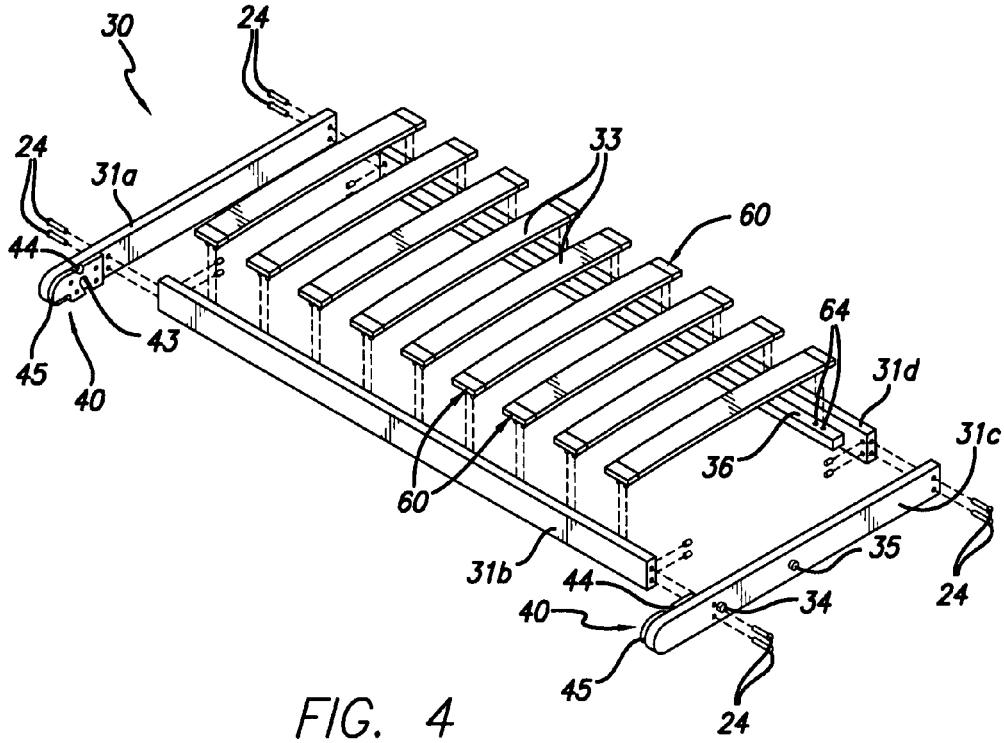
FIG. 4 is an exploded perspective view of a back-deck of the futon sofa bed frame of FIG. 1.

With additional reference to FIG. 4, the back-deck 30 may also include multiple rails, for example rails 31*a-d*, which may be coupled or connected together in a fashion similar to the rails 21*a-d* of the seat-deck 20, discussed above. Specifically, end portions of the rails 31*a-d* may be coupled together to form/define a boundary enclosing a region 32 having multiple slats 33. For example, in example embodiments the region 32 may include a generally rectangular shape, but may include any other shape desired within the scope of the present disclosure. To that end, the illustrated back-deck 30 may include four rails 31*a-d* coupled together by fasteners 24 (e.g., screws, bolts, etc.) (FIG. 3) to form the generally rectangular shape. Rails 31*a* and 31*c* are spaced apart and extend generally parallel to each other, and rails 31*b* and 31*d* extend generally transverse thereto. Rails 31*b* and 31*d* are also spaced apart and extend generally parallel to each other, with the slats 33 extending between the rails 31*b* and 31*d*. Supports 36 (FIG. 3) are configured lengthwise along inside faces of rails 31*b* and 31*d* to provide support underneath the slats 33 and/or locations to connect the slats 33 to the rails 31*b* and 31*d*, as will be described in more detail hereinafter.

The slats 23 of the seat-deck 20 and the slats 33 of the back-deck 30 are connected to or installed on the respective seat-deck 20 and back-deck 33 by slat connectors 60. The slat connectors 60 may be made of plastic, metal, etc. within the scope of the present disclosure, and may be installed on end portions of the slats 23 and 33 to allow the end user to connect the slats 23 and 33 to the seat-deck 20 and back-deck 30. In example embodiments, the slat connectors 60 may be installed on the end portions of the slats 23 and 33 by sliding the connectors 60 over the end portions of the slats 23 and 33 to allow the end user to connect the slats 23 and 33 to the supports 26 and 36 of the seat-deck 20 and back-deck 30, respectively. The slat connectors 60 may simplify, reduce, and/or minimize assembly of the futon sofa bed frame 1 and installation of the slats 23 and 33 in the futon frame 1 because no tools or hardware may be needed for installation of the slats 23 and 33. For example, an end user may be able to install the slats 23 and 33 of the futon sofa bed frame 1 without inserting hardware (e.g., screws, bolts, nails, etc.) into the slats 23 and 33. Moreover, components of the futon sofa bed frame 1 may be compactly packaged for shipping to end users as pre-connected hardware (e.g., screws, bolts, nails, etc.) may not extend from, for example, slats 23 and 33 during shipping. While slat connectors 60 are disclosed in example embodiments in combination with the wooden futon sofa bed frame 1, the slat connectors 60 are not limited thereto. For example, the slat connectors 60 may be used in combination with a metal futon sofa bed, a wooden frame bed, a metal frame bed, or the like within the scope of the present disclosure.

Figure 5:
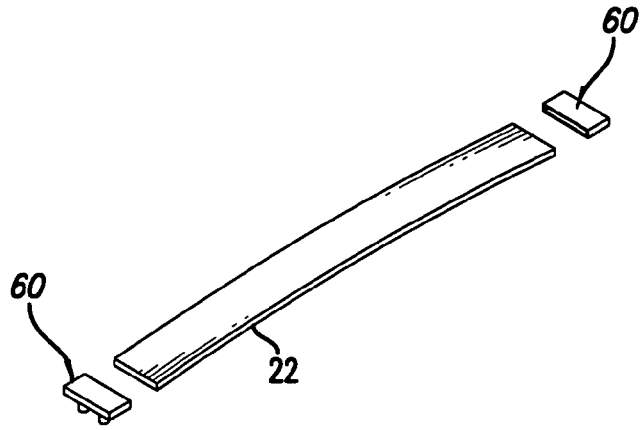
FIG. 5 is a perspective view of a seat-deck slat and two slat connectors for connecting the seat-deck slat to seat-deck rails of the futon sofa bed frame of FIG. 1.
Figure 6:
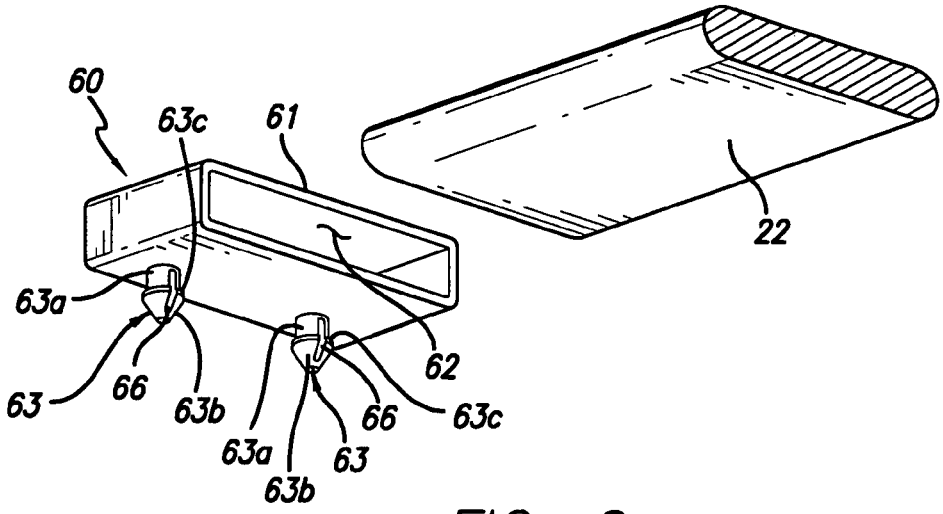
FIG. 6 is an enlarged lower perspective view of a slat connector of FIG. 5 and an end portion of the seat-deck slat.
Figure 7:
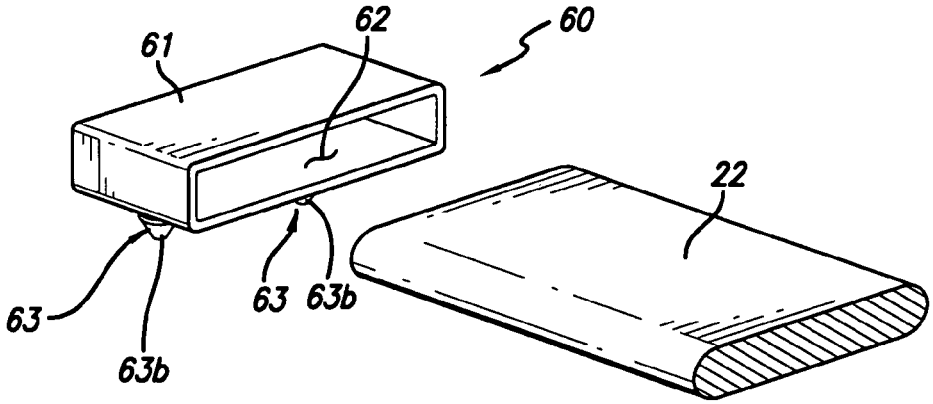
FIG. 7 is an enlarged upper perspective view of the slat connector of FIG. 6 and the end portion of the seat-deck slat.

The slat connectors 60 will now be described in more detail with reference to FIGS. 5, 6, and 7. The following generally describes the slat connectors 60 used with slats 23 of the seat-deck 20. A description of the slat connectors 60 as used with slats 33 of the back-deck 30 would be substantially the same. In FIG. 5, two example slat connectors 60 are illustrated together with a slat 23 of the seat-deck 20. The slat connectors 60 are positioned adjacent end portions of the slat 23 for installation to the slat 23. As shown in FIGS. 6 and 7, each slat connector 60 may include a generally rectangular connector body 61 and an opening 62 in the body 61. The opening 62 of each connector 60 may be formed in the connector body 61 to receive an end portion of the slat 23. The opening 62 may be formed in a generally rectangular shape slightly larger than the cross-sectional contour of the slat 23. In other example embodiments, slat connectors may include openings shaped closely approximating cross-sectional contours/shapes of slats to be received by the connectors.

With reference to FIG. 6, each slat connector 60 also may include protrusions, for example pegs 63, formed on an outer surface of the connector body 61. The illustrated connector 60 may include two spaced apart pegs 63 formed integrally on an outer, lower surface of the connector body 61 and protruding generally away from the connector body 61 in a generally normal direction. In other example embodiments, connectors may include more than or fewer than two protrusions, protrusions formed as separate units with connector bodies, protrusions formed on side surfaces of connector bodies, etc.

The pegs 63 of the slat connectors 60 each include a first portion 63*a* extending from the surface of the connector body 61 and a second portion 63*b* extending from the first portion 63*a*. The first portion 63*a* has a generally cylindrical shape and the second portion 63*b* has a generally conical shape with a peak directed generally away from the first portion 63*a* and connector body 61. Furthermore, at least a base 63*c* of the second portion 63*b* may have a width dimension (e.g., a diameter) greater than a width dimension (e.g., a diameter) of the first portion 63*a*. It should be understood that the first portion 63*a* and second portion 63*b* are not limited to the above mentioned shapes and may have other shapes within the scope of the present disclosure.

To install the slats 23 to the seat-deck 20 (and the slats 33 to the back-deck 30), the slat connectors 60 at the end portions of the slats 23 are positioned over the support 26 of the seat-deck 20, and the second portions 63*b* of the pegs 63 are press-fit (e.g., hand pressed without use of tools, etc.) into openings 64 (FIG. 4) in the support 26. The openings 64 may be smaller widthwise than the second portions 63*b* of the pegs 63 (e.g., than base 63*c* of the second portion 63*b*) such that each of the peg's second portions 63*b* grab securely inside respective openings 64 and against interior sidewalls of the openings 64 to help secure the slats 23 to the support 26 and form the seat-deck 20 of the frame 1. In other example embodiments, slat connectors may include pegs with second portions that extend completely through openings in frames from forward sides of the openings to rearward sides of the openings such that bases of the second portions pass through the openings and rest against rearward sides of the frames. In still other example embodiments, slat connectors may include pegs formed on side surfaces and/or end surfaces of the slat connectors so that the pegs may be inserted laterally into holes formed in futon sofa bed frames (e.g., supports of seat-decks and/or back-decks of the frames).

As shown in FIG. 6, a slot 66 may be formed lengthwise in one or more of the pegs 63 of each slat connector 60. The slot 66 may allow the peg 63 to contract, or deform, when press-fit into a support opening 64 so that the peg 63 can snugly fit into the smaller dimension opening 64. For example, when the peg 63 is inserted (e.g., press-fit) into an opening 64, the first portion 63*a* and the second portion 63*b* squeeze together at the location of the slot 66. This allows the peg 63 to move into the opening 64 and grab inside surfaces of the opening 64. In example embodiments where second portions of pegs may extend completely through openings in frames, the pegs may expand back to their original shape (e.g., their original diameter). Here, the pegs may have larger surface areas in contact with undersides of frames (e.g., undersides of supports of the frames), which may provide greater resistance to the pegs being pulled out of the openings.

Referring again to FIGS. 1 and 2, assembly, or connection, of the seat-deck 20 and back-deck 30 of the futon sofa bed frame 1 will be described. The seat-deck 20 and back-deck 30 may be pivotally connected such that the frame 1 can move between an open position and a closed position. In the closed position, the seat-deck 20 and back-deck 30 sit in different planes relative to each other. The seat-deck 20 rests on the stretcher rail 8, for example in a roughly horizontal plane, and the back-deck 30 sits, for example, generally upright in a roughly vertical plane. Here, the frame 1 is in a seating or sofa position. In the fully open position, the seat-deck 20 and back-deck 30 lie generally in a common plane, with the angle therebetween measuring, for example, about 180 degrees. Here, the back-deck 30 rests on the rearward stretcher rail 9 and the seat-deck 20 rests on the forward stretcher rail 8.

The back-deck 30 may first be connected to the arm panels 7. With additional reference to FIGS. 3 and 4, runners 34 and 35 located on the side rails 31*a* and 31*c* of the back-deck 30 may be coupled with tracks 14 and 15 located in the arm panels 7 (FIGS. 1 and 2). The back-deck 30 may be set in between the arm panels 7 and manually held in a position with the back-deck runners 34 approximately vertical over the respective arm panel tracks 14 for both arm panels 7. The back-deck may then be manually lowered until one runner 34 comes to sit and be supported in track 14 for both arm panels 7. The other runner 35 may be lifted and placed into track 15 for both arm panels 7. The back-deck 30 is now operational and ready to have the seat-deck 20 attached for use. The back-deck tracks 14 and 15 may be formed as grooves formed into each arm panel 7. In other example embodiments, plastic pieces including tracks may be attached to arm panels.

To connect the seat-deck 20 to the back-deck 30, receiving pegs 50 and 51 provided on outside faces of the rails 21*a* and 21*d* of the seat-deck 20 are connected to connecting blocks 40 mounted on inside faces of the rails 31*a* and 31*c* of the back-deck 30. When combined and operated together, the connecting blocks 40 and receiving pegs 50 and 51 are relatively movable to create a mechanism that allows a user to convert the frame 1 between the closed position and the fully open position while, for example, standing only at the front of the frame 1. This will be described in more detail hereinafter. The connecting blocks 40 may be mounted on the back-deck rails 31*a* and 31*c* by fasteners such as screws, bolts, etc., or the connecting blocks 40 may be formed integral with the back-deck rails 31*a*, 31*c* within the scope of the present disclosure.

The receiving pegs 50 and 51 are located laterally of the seat-deck rails 21*a* and 21*c* generally along a center line of the rails 21*a* and 21*d*, with one receiving peg 51 located nearest the far lower end of rails 21*a* and 21*d* and the other receiving peg 50 spaced inward therefrom along the rail center lines. The receiving pegs 50 and 51 may be formed from a variety of materials including wood, metal, plastic (e.g., high density plastic), etc and separately attached to the rails 21*a* and 21*d*, or the receiving pegs 50 and 51 may be formed integrally with the rails 21*a* and 21*d*. The receiving pegs 50 and 51 may also incorporate wheels or rolling surfaces to facilitate their movement relative to the connecting blocks 40 within the scope of the present disclosure.

The seat-deck 20 and back-deck 30 are mechanically joined by respectively positioning the receiving pegs 50 and 51 into one of a groove 43 and/or notches 44 and 45 of the connecting block 40. In this position, the receiving pegs 50 and 51 may act as pivot pegs, moving pegs or locking pegs depending on the different positions they are moved to when, for example, moving the frame 1 between the closed position and fully open position. In the closed position, the receiving pegs 50 and 51 may be positioned respectively in notch 44 and groove 43. Disassembly of the frame 1 may be achieved by using this same operation in reverse.

47 To move the frame 1 from the closed position to the fully open position, the user may lift a forward side of the seat-deck 20. The receiving peg 51 pivots in groove 43 and the receiving peg 50 rises from notch 44 over the top of block 40. The back-deck 30 (via sliding pegs 50 and 51) slides along channels 14 and 15 into a generally horizontal configuration. The seat-deck 20 may then be lowered to a generally horizontal configuration in plane with the back-deck 30. This moves the receiving peg 50 over the connecting block 40 and into the notch 45. Moving the frame 1 from the fully open position to the closed position may be achieved by using the same operation in reverse.

Figure 8:
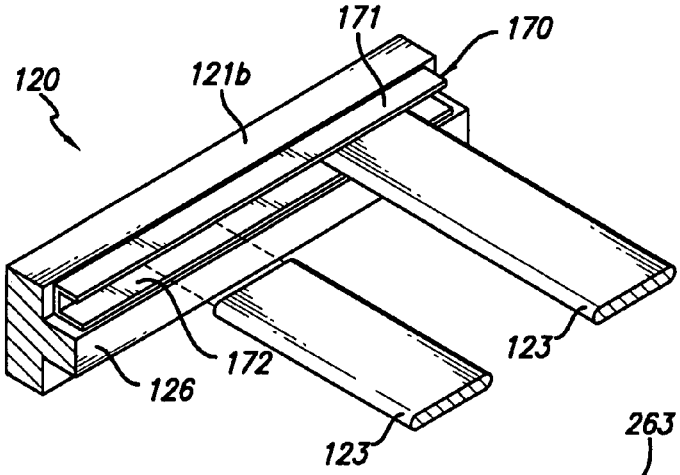
FIG. 8 is a perspective view of part of a seat-deck of a futon sofa bed frame according to another example embodiment illustrating installation of seat-deck slats to a seat-deck rail of the frame.

FIG. 8 illustrates part of a seat-deck 120 of a futon sofa bed frame according to another example embodiment. Here, a rail 121*b* of the seat-deck 120 is generally T-shaped such that a support 126 is formed integrally with the rail 121*b*. The support 126 may be formed separately from the rail 121*b* and attached thereto within the scope of the present disclosure. In addition, a guide 170 having a body 171 may be mounted on the support 126 for connecting slats 123 to the seat-deck rail 121*b*. The guide 170 may include a channel opening 172 configured to receive end portions of the slats 123 therein to assemble at least part of the seat-deck 120. The guide channel opening 172 may be similarly sized/dimensioned to, for example, a thickness dimension of the slats 123 so that the slats 123 are securely received by the guide 170. While connection of slats 123 to only one rail 121*b* of the seat-deck 120 is shown and described, it is understood that a description of connection of the slats 123 to an opposing rail of the seat-deck 120 to form the entire seat-deck 120 would be substantially the same. In addition, slats of a back-deck may be similarly connected to back-deck rails to form the back-deck.

Figure 9:
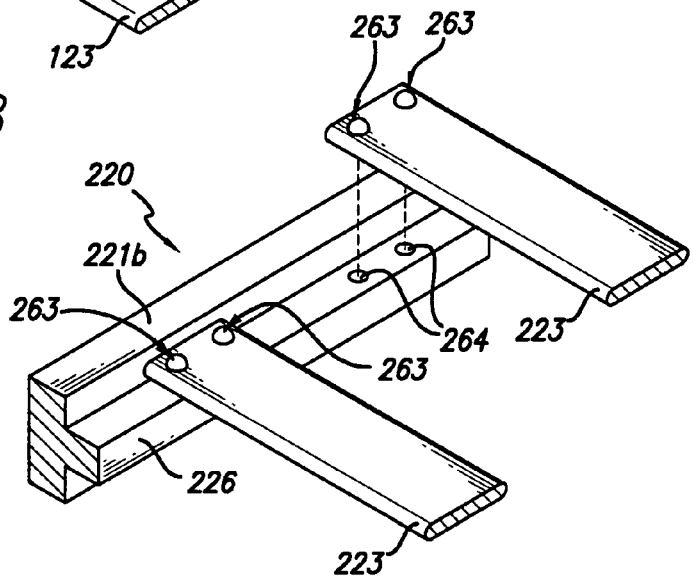
FIG. 9 is a perspective view of part of a seat-deck of a futon sofa bed frame according to still another example embodiment illustrating installation of seat-deck slats to a seat-deck rail of the frame.
Figure 10:
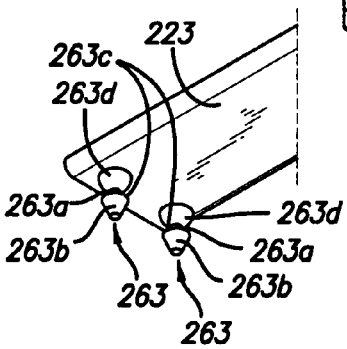
FIG. 10 is a lower perspective view of a seat-deck slat of FIG. 9.

FIGS. 9 and 10 illustrate part of a seat-deck 220 of a futon sofa bed frame according to still another example embodiment. A rail 221*b* of the seat-deck 220 may be generally T-shaped such that a support 226 is formed integrally with the rail 221*b* for receiving slats 223 in forming the seat-deck 220. The support 226 may be formed separately from the rail 221 b and attached thereto within the scope of the present disclosure.

In example embodiments, each slat 223 may include a slat connector, for example one or more pegs 263 (broadly, "protrusions"), located toward a longitudinal end portion of the slat 223 for connecting the slat 223 to the support 226. The slats 223 in FIGS. 9 and 10 are illustrated with two pegs 263. The pegs 263 may be formed on a lower surface of the slat 223 and may protrude in a substantially normal direction from the slat 223. The pegs 223 may be formed as an integrated unit with the slat 223, or they may be formed separately from the slat 223 and attached thereto, for example through openings (not'shown) in the slat 223, within the scope of the present disclosure.

As shown in FIG. 10, each peg 263 may include a base portion 263*d* extending from a surface of the slat 223, a narrowed first portion 263*a* extending from the base portion 263*d*, and a second portion 263*b* extending from the first portion 263*a*. The first portion 263*a* has a generally cylindrical shape and the second portion 263*b* has a generally conical shape with a peak directed generally away from the first portion 263*a*. Furthermore, at least a base 263*c* of the second portion 263*b* may have a width dimension (e.g., a diameter) greater than a width dimension (e.g., a diameter) of the first portion 263*a*.

As shown in FIG. 9, to install the slats 223 to rail 221*b* to form the seat-deck 220, the pegs 263 at the end portions of the slats 223 are positioned over the support 226 of rail 221*b*, and the second portions 263*b* of the pegs 263 are press-fit into openings 264 in the support 226. The openings 264 may be smaller widthwise than the second portion 263*b* of the pegs 263 (e.g., than base 263*c* of the second portion 263*b*) such that each of the peg's second portions 263*b* grab securely inside respective openings 264 and against interior sidewalls of the openings 264 to help secure the slats 223 to the support 226. While connection of slats 223 to only one rail 221*b* of the seat-deck 220 is shown and described, it is understood that a description of connection of the slats 223 to an opposing rail of the seat-deck 220 to form the entire seat-deck 220 would be substantially the same. In addition, slats of a back-deck may be similarly connected to back-deck rails to form the back-deck.

Figure 11:
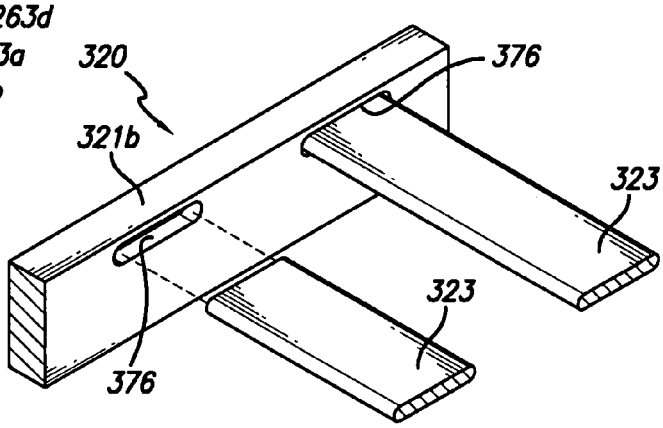
FIG. 11 is a perspective view of part of a seat-deck of a futon sofa bed frame according to another example embodiment illustrating installation of seat-deck slats to a seat-deck rail of the frame.

FIG. 11 illustrates part of a seat-deck 320 of a futon sofa bed frame according to another example embodiment. Here, a rail 321*b* of the seat-deck 320 is generally rectangular in cross-section and may include openings 376 (broadly, "guides") formed in an inward side-face of the rail 321*b* for connecting slats 323 to the rail 321*b* to form at least part of the seat-deck 320. The openings 376 are configured to receiving end portions of the slats 323 therein. The openings 376 may be similarly sized/dimensioned to, for example, a cross-sectional dimension of the slats 323 so that the slats may be securely received in the openings 376. While connection of slats 323 to only one rail 321*b* of the seat-deck 320 is shown and described, it is understood that a description of connection of the slats 323 to an opposing rail of the seat-deck 320 to form the entire seat-deck 320 would be substantially the same. In addition, slats of a back-deck may be similarly connected to back-deck rails to form the back-deck.

Figure 12:
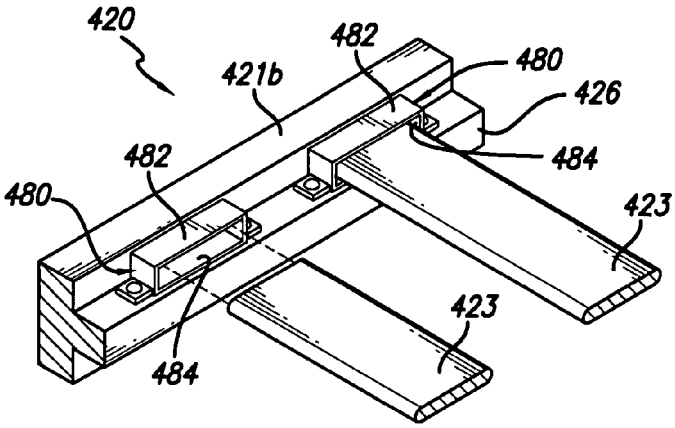
FIG. 12 is a perspective view of part of a seat-deck of a futon sofa bed frame according to yet another example embodiment illustrating installation of seat-deck slats to a seat-deck rail of the frame.

54 FIG. 12 illustrates part of a seat-deck 420 of a futon sofa bed frame according to yet another example embodiment. Here, a rail 421*b* of the seat-deck 420 may be generally T-shaped such that a support 426 is formed integrally with the rail 421*b*. The support 426 may be formed separately from the rail 421*b* and attached thereto within the scope of the present disclosure. In addition, guides 480 are mounted on the support 426 for connecting slats 423 to the seat-deck rail 421*b*. The guides 480 each include a body 482 with an opening 484 therein configured to receive end portions of the slats 423 to assemble at least part of the seat-deck 420. The guide openings 484 may be formed in a generally rectangular shape slightly larger than the cross-sectional contour of the slats 423. In other example embodiments, guides may include openings formed in a shape closely approximating cross-sectional contours of slats to be received by the connectors. While connection of slats 423 to only one rail 421*b* of the seat-deck 420 is shown and described, it is understood that a description of connection of the slats 423 to an opposing rail of the seat-deck 420 to form the entire seat-deck 420 would be substantially the same. In addition, slats of a back-deck may be similarly connected to back-deck rails to form the back-deck.

Figure 13:
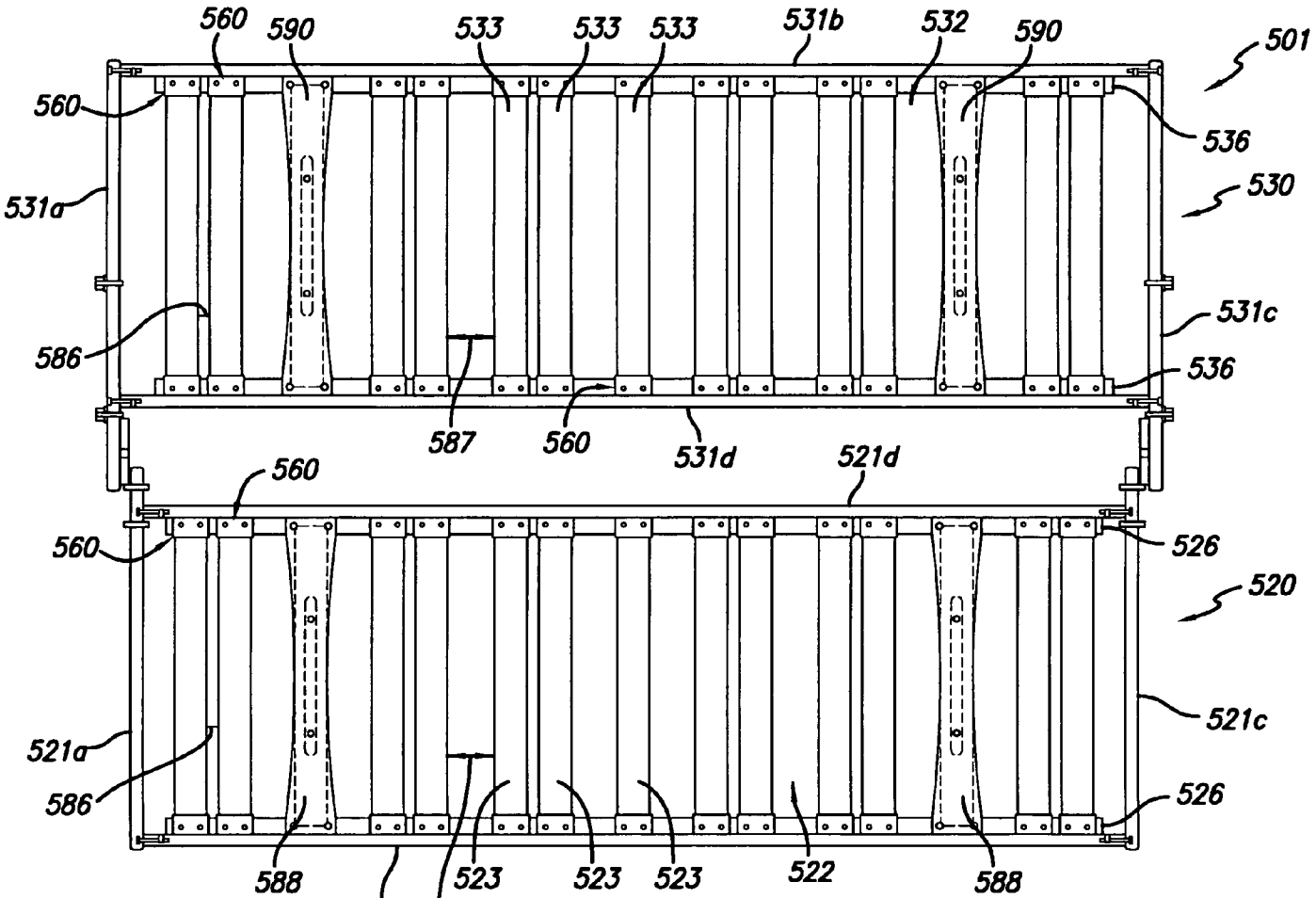
FIG. 13 is a top plan view of another example embodiment of a frame for a futon sofa bed.

FIG. 13 illustrates another example embodiment of a futon sofa bed frame 501. The frame 501 is shown in a fully open position and may include a seat-deck 520 and a back-deck 530 operatively connected to the seat deck 520 for relative movement between the fully open position and a closed (or seating) position. The seat-deck 520 may include four rails 521*a-d* coupled together to form a boundary, enclosing a region 522 having slats 523. For example, in example embodiments the region 522 may be a generally rectangular shape and may include thirteen slats 523. The region 522 may include more than or fewer than thirteen slats 523 within the scope of the present disclosure. The slats 523 are oriented generally in pairs, with three pairs of slats 523 located on either side of a single central slat 523. A spacing 586 between slats 523 of each pair of slats 523 may be about uniform for each of the pairs, and each pair of slats 523 may be spaced apart from an adjacent pair of slats 523 by a distance (e.g., distance 587) that is larger than the distance 586 between slats 523 of each pair. The slats 523 may be connected or installed to rails 521*b* and 521*d* of the seat-deck 520 by slat connectors 560. The seat-deck region 522 also may include two interior cross rails 588 located inwardly of each outwardly located pair of slats 523 for providing additional support to the seat-deck 520 and frame 501. Supports 526 are configured lengthwise along inside faces of rails 521*b* and 521*d* to provide support underneath the slats 523 and/or locations to connect the slats 523 to the rails 521*b* and 521*d*. The slats 523 may be connected to the supports 526 and/or rails 521*b* and 521*d* of the seat-deck 520 as disclosed herein, or by any other acceptable connection.

The back-deck 530 also may include four rails 531*a-d* that are coupled together in a fashion similar to the rails 521*a-d* of the seat-deck 520 to form a boundary region 532 having slats 533. For example, in example embodiments, the region 532 is a generally rectangular shape and may include thirteen slats 533. The region 532 may include more than or fewer than thirteen slats 533 within the scope of the present disclosure. The slats 533 are oriented similarly to the slats 523 of the seat-deck 520. The slats 533 are oriented generally into pairs, with three pairs of slats 533 located on either side of a single central slat 533. A spacing 586 between slats 533 of each pair of slats 533 may be about uniform for each of the pairs, and each pair of slats 533 may be spaced apart from an adjacent pair of slats 533 by a distance (e.g., distance 587) that is larger than the distance 586 between slats 533 of each pair. The slats 533 may be connected or installed to rails 531*b* and 531*d* of the back-deck 530 by slat connectors 560. Two interior cross rails 590 are located inwardly of each outwardly located pair of slats 533 for providing additional support to the back-deck 530 and frame 501. Supports 536 are configured lengthwise along the inside face of rails 531*b* and 531*d* to provide support underneath the slats 533 and/or locations to connect the slats 533 to the rails 531*b* and 531*d*. The slats 533 may be connected to the support 536 and/or rails 531*b* and 531*d* of the back-deck 530 as disclosed herein, or by any other acceptable connection.

Figure 15:
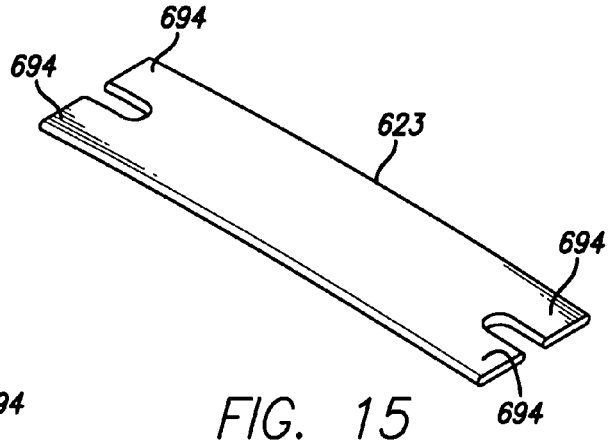
FIG. 15 is an enlarged perspective view of a seat-deck slat of the futon sofa bed frame of FIG. 14.
Figure 16:
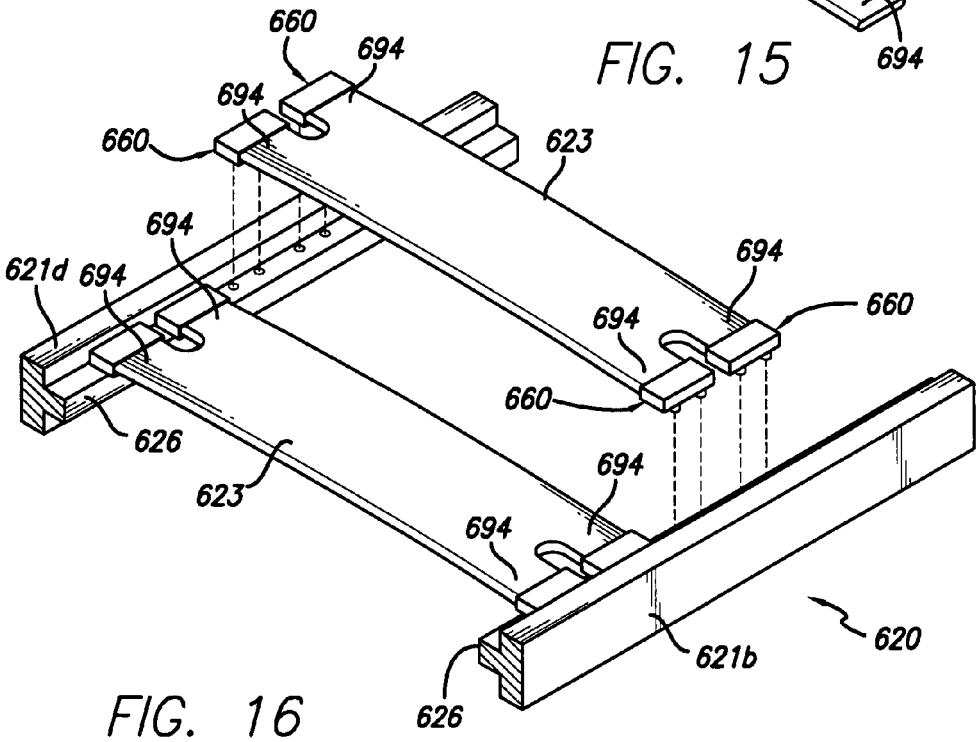
FIG. 16 is an enlarged perspective view of part of a seat-deck of the futon sofa bed frame of FIG. 14 illustrating installation of seat-deck slats to seat-deck rails of the frame.
Figure 14:
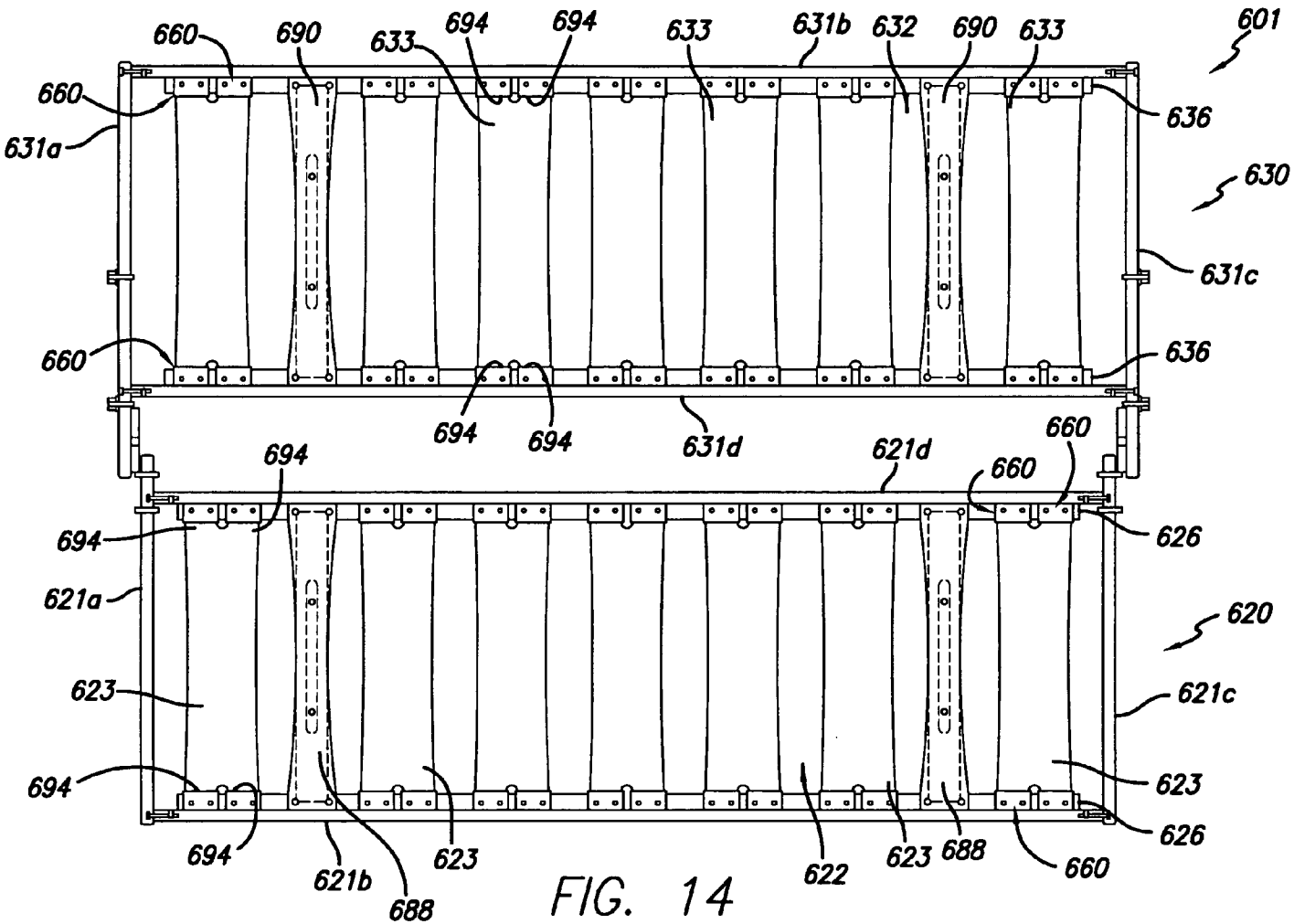
FIG. 14 is a top plan view of a further example embodiment of a frame for a futon sofa bed.

FIGS. 14-16 illustrate another example embodiment of a futon sofa bed frame 601. In FIG. 14, the frame 601 is shown in a fully open position and may include a seat-deck 620 and a back-deck 630 operatively connected to the seat deck 620 for relative movement between the fully open position and a closed (or seating) position. The seat-deck 620 may include four rails 621*a-d* coupled together to form a boundary enclosing a region 622 having slats 623. For example, in example embodiments the region 622 may be a generally rectangular shape and may include seven slats 623. The region 622 may include more than or fewer than seven slats 623 within the scope of the present disclosure. The slats 623 are wider than illustrated in the previous embodiment such that fewer slats 623 are required. In addition, end portions of each slat 623 are divided to form two end tabs 694 for connecting the slat 623, for example, to the rails 621*b* and 621*d* to form the seat-deck 620 (also see FIGS. 15 and 16). In example embodiments, the slats 623 are generally uniformly spaced along a length of the seat-deck 620 but may be spaced differently within the scope of the present disclosure. The slats 623 may be connected or installed to rails 621*b* and 621*d* of the seat-deck 620 by slat connectors 660 at the end tabs 694 of the slats 623. The seat-deck region 622 also may include two interior cross rails 688 located inwardly of each outwardly located slat 623 for providing additional support to the seat-deck 620 and frame 601. Supports 626 are configured lengthwise along inside faces of rails 621*b* and 621*d* to provide support underneath the slats 623 and/or locations to connect the slats 623 to the rails 621*b* and 621*d*. The slats 623 may be connected to the supports 626 and/or rails 621*b* and 621*d* of the seat-deck 620 as disclosed herein, or by any other acceptable connection.

The back-deck 630 also may include four rails 631*a-d* that are coupled together in a fashion similar to the rails 621*a-d* of the seat-deck 620 to form a boundary region 632 having slats 633. For example, in example embodiments the region 632 may be a generally rectangular shape and may include seven slats 633. The region 632 may include more than or fewer than seven slats 633 within the scope of the present disclosure. The slats 633 are substantially the same as those described above for the seat-deck 620 and are oriented similarly to the slats 623 of the seat-deck 620. These slats 633 are also wider than illustrated in the previous embodiment such that here fewer slats 633 are required. In example embodiments, the slats 633 are generally uniformly spaced along a length of the back-deck 630, but they may be spaced differently within the scope of the present disclosure. In addition, end portions of each slat 633 are divided to form two end tabs 694 for connecting the slat 633, for example, to the rails 631*b* and 631*d* to form the back-deck 630. The slats 633 may be connected or installed to rails 631*b* and 631*d* of the back-deck 630 by slat connectors 660 at the end tabs 694 of the slats 633. The back-deck region 632 also may include two interior cross rails 690 located inwardly of each outwardly located slat 633 for providing additional support to the back-deck 630 and frame 601. Supports 636 are configured lengthwise along inside faces of rails 631*b* and 631*d* to provide support underneath the slats 633 and/or locations to connect the slats 633 to the rails 631*b* and 631*d*. The slats 633 may be connected to the supports 636 and/or rails 631*b* and 631*d* of the back-deck 630 as disclosed herein, or by any other acceptable connection.

Although example embodiments are directed to a futon sofa bed including numerous features and variations thereof, example embodiments are not to be limited to the specific combinations of features and variations disclosed herein. The principles and features of the disclosed embodiments may be employed in varied and numerous embodiments without departing from the scope of the invention, as defined by the appended claims.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof. As used herein, the term "and/or" includes any and all combinations of one or more of the associated listed items.

It will be understood that, although the terms first, second, third etc. may be used herein to describe various elements, components, regions, portions, and/or sections, these elements, components, regions, portions, and/or sections should not be limited by these terms. These terms are only used to distinguish one element, component, region, portion, or section from another element, component, region, portion, or section. Thus, a first element, component, region, portion, or section discussed below could be termed a second element, component, region, portion, or section without departing from the scope of the example embodiments.

Spatially relative terms, such as "beneath," "below," "lower," "above," "upper" and the like, may be used herein for ease of description to describe one element or a relationship between a feature and another element or feature as illustrated in the figures. It will be understood that the spatially relative terms are intended to encompass different orientations of the device in use or operation in addition to the orientation depicted in the drawings. For example, if the device in the drawings is turned over, elements described as "below" or "beneath" other elements or features would then be oriented "above" the other elements or features. Thus, for example, the term "below" can encompass both an orientation which is above as well as below. The device may be otherwise oriented (rotated 90 degrees or viewed or referenced at other orientations) and the spatially relative descriptors used herein should be interpreted accordingly.

Unless otherwise defined, all terms (including technical and scientific terms) used herein have the same meaning as commonly understood by one of ordinary skill in the art to which example embodiments belong. It will be further understood that terms used herein should be interpreted as having a meaning that is consistent with their meaning in the context of this specification and the relevant art and will not be interpreted in an idealized or overly formal sense unless expressly so defined herein.

What is claimed is:

1. A frame for a futon sofa bed, the frame comprising:

rails coupled together to define a deck region, the rails extending in a first direction and including first and second opposing rails extending in the first direction, the first rail having a support, the support including a horizontal support surface below an uppermost surface of the first rail, the horizontal support surface extending lengthwise along an inside face of the first rail, the horizontal support surface further including an opening passing through the horizontal support surface so that the opening is below the uppermost surface of the first rail and above the lowermost surface of the first rail;

a slat extending between the first and second opposing rails within said deck region and connecting to the first and second opposing rails, the slat extending in a direction substantially perpendicular to the first direction;

a connector connecting the slat to the first rail, the connector including a protrusion configured for reception within the opening of the horizontal support surface of the first rail for connecting the slat to the first rail, at least part of the protrusion received within the opening having a width dimension larger than a width dimension of the opening and being deformable for allowing reception of the protrusion into the opening.

2. The frame of claim 1, wherein the protrusion includes a first portion extending away from the slat and a second portion extending away from the first portion, the second portion including a base having a width dimension greater than a corresponding width dimension of the first portion.

3. The frame of claim 2, wherein the opening formed in the horizontal support surface extends through the support from a top side of the support to a bottom side of the support, the second portion of the protrusion extending through the opening such that at least part of the base of the second portion is disposed against the bottom side of the support when the slat is connected to the support.

4. The frame of claim 1, wherein the connector protrusion is configured to press-fit into the opening of the first rail independent of tools.

5. The frame of claim 1, wherein the connector includes a body having an opening for receiving an end portion of the slat into the opening, the connector protrusion extending in a generally vertical direction from an outer surface of the body for reception within the opening of the horizontal support surface.

6. The frame of claim 1, wherein the slat includes an opening for installing the connector protrusion to the slat through the opening.

7. The frame of claim 1, comprising multiple slats and multiple connectors, one connector being on each end portion of each of the slats for connecting each of the slats to the first and second opposing rails.

8. The frame of claim 1, wherein the deck region includes one or more of a back-deck region and a seat-deck region.

9. A frame for a futon sofa bed, the frame comprising:

rails coupled together to define a deck region, the rails including first and second opposing rails;

slats connected between the first and second opposing rails within said deck region;

at least one of the slats having a longitudinal end including at least two end tabs connecting the at least one slat to the first rail;

a first protrusion on a first end tab of the at least two end tabs, the first protrusion connecting the first end tab to the first rail; and a second protrusion on a second end tab of the at least two end tabs, the second protrusion connecting the second end tab to the first rail, wherein the first and second protrusions are spaced apart from one another.

10. The frame of claim 9, further comprising:

a first slat connector and a second slat connector, wherein the first slat connector encloses the first end tab and the second slat connector encloses the second end tab, and the first slat connector includes the first protrusion and the second slat connector includes the second protrusion.

11. A frame for a futon sofa bed, the frame comprising:

rails coupled together to define a deck region, the rails including first and second opposing rails, the first rail including a support member having a plurality of holes passing vertically through the support member;

horizontal slats connected between the first and second opposing rails within said deck region in spaced apart orientation, the slats including consecutively positioned first, second, third, and fourth slats, the slats being connected to the first rail via the plurality of holes;

wherein a spacing between the first and second slats is about the same as a spacing between the third and fourth slats, and wherein a spacing between the second and third slats is greater than the spacing between the first and second slats and the spacing between the third and fourth slats.

12. The frame of claim 11, comprising twenty-four or more slats.

* * * * *